US005359325A

United States Patent [19]

Ford et al.

[11] Patent Number: 5,359,325

[45] Date of Patent: Oct. 25, 1994

[54] AUTOMATIC MONITORING SYSTEM FOR AIRFIELD LIGHTING SYSTEMS

[75] Inventors: Seward E. Ford, Windsor, Conn.; Simcha Ohrenstein, Tel-Aviv, Israel

[73] Assignee: Cooper Industries, Inc., Houston, Tex.

[21] Appl. No.: 770,686

[22] Filed: Oct. 3, 1991

[51] Int. Cl.[5] ..... G08G 5/00

[52] U.S. Cl. ..... 340/953; 315/130; 340/642

[58] Field of Search ..... 340/953, 945, 947, 954, 340/955, 956, 458, 642, 292; 244/114 R; 315/130

[56] References Cited

U.S. PATENT DOCUMENTS

| | | | |
|---|---|---|---|
| 3,715,741 | 2/1973 | McWade et al. | 340/953 |
| 4,675,574 | 6/1987 | Delflache | 340/642 |
| 4,951,046 | 8/1990 | Lambert et al. | 340/953 |
| 5,034,659 | 7/1991 | Taniguchi | 315/130 |

FOREIGN PATENT DOCUMENTS

| | | | |
|---|---|---|---|
| 1506451 | 4/1978 | United Kingdom | 315/130 |

*Primary Examiner*—Brent Swarthout

*Attorney, Agent, or Firm*—Conley, Rose & Tayon

[57] ABSTRACT

A runway lighting system comprises a series runway transmission line providing current to a plurality of runway lamps. A failed lamp indicator (FLI) connects across the terminals of each lamp to determine when the lamp is malfunctioning. When the FLI determines that a lamp is malfunctioning, the FLI transmits a malfunction signal, during a specific time period defined in lamp address circuitry in each FLI, onto the existing series runway transmission line. A circuit status analyzer (CSA), which forms part of the vault computer, receives the malfunction signal, noting the time period during which the signal was received. The CSA then accesses an internal ROM look-up table to determine which FLI sent the signal.

11 Claims, 3 Drawing Sheets

AUTOMATIC MONITORING SYSTEM FOR AIRFIELD LIGHTING SYSTEMS

BACKGROUND OF THE INVENTION

The present invention relates generally to an airport runway lighting system substantially as disclosed in commonly assigned U.S. Pat. No. 4,951,046. More particularly, the present invention comprises an automated monitoring system for observing the condition of lamps in the runway lighting system. Still more particularly, the present invention monitors the status of failed lamps and determines when these lamps must be replaced to insure continuity of guidance along a particular runway.

Existing airport runways typically include a series of runway light fixtures secured along the centerline and/or sidelines of an airport runway. Each light fixture includes one or more lamps which provide illumination to aircraft. The fixtures secured along a length of runway each are coupled by means of a series current transformer to a single alternating current transmission line extending from a constant current regulator through an electrical vault beneath the runway. Typically, each constant current regulator connects to a single current transmission line. Each constant current regulator, in turn, connects to a vault computer.

The constant current regulator typically generates a current at one of five preselected amplitudes, including 2.8, 3.4, 4.1, 5.2, and 6.6 RMS amperes. A lighting control panel located in the airport control tower transmits commands to the vault computer which controls the amplitude of current generated by the current regulator. The lighting control panel thereby enables airport personnel in the control tower to select individually the intensity of runway light illumination for each runway.

The monitoring of the airfield lighting system is critical for safe operation. As is apparent to one skilled in the art, safe operation of a runway can be compromised if an excessive number of runway lamps malfunction, especially if adjacent lamps malfunction, thereby changing the configuration of the runway lighting system.

ICAO ANNEX 14 recommends that

> In order to provide continuity of guidance . . . an unserviceable light should not be permitted adjacent to another unserviceable light . . .

Thus, it should be apparent to those skilled in the art that an automatic monitoring system for runway lights would be beneficial and would enhance the safety of a runway lighting system. Such a monitoring system, however, has not been implemented because adopting such a system would require that existing systems be retrofitted with additional transmission lines and monitoring equipment, thereby making implementation costs prohibitively expensive.

SUMMARY OF THE INVENTION

Accordingly, a monitoring system for a runway lighting system constructed in accordance with the principles of the present invention comprises an existing current transmission line connected in series to each light fixture in a particular runway, a failed lamp indicator ("FLI") installed at each light fixture location, a constant current regulator, and a circuit status analyzer ("CSA") connected to the series transmission line through a voltage transformer. The circuit analyzer may be connected to a plurality of constant current regulators and transmission lines. The circuit status analyzer connects to both an airport control tower and to a maintenance monitoring unit.

The failed lamp indicator ("FLI") comprises circuitry for measuring the voltage across the lamp. When the voltage across the lamp becomes excessive indicating a failed lamp, the failed lamp indicator (FLI) shorts out the lamp and provides an output signal, during a specific time frame, to indicate that particular lamp has failed. Because each failed lamp indicator ("FLI") transmits an output signal at a specific time, or during a specific "window", the circuit status analyzer ("CSA") can specifically identify the defective lamp. The analyzer then determines the location and number of burned out lamps and decides if immediate action is required.

As one skilled in the art will immediately realize, a runway lighting system constructed in accordance with the principles of the present invention enables one to determine the exact lamp that has failed or has become defective. In addition, the present system is advantageous in that existing running circuitry can be used to practice the invention. These and various other characteristics and advantages of the present invention will become readily apparent to those skilled in the art upon reading the following detailed description and claims and by referring to the accompanying drawings.

BRIEF DESCRIPTION OF THE DRAWINGS

For a more detailed description of the preferred embodiment of the invention, reference will now be made to the accompanying drawings, wherein.

DETAILED DESCRIPTION OF THE PREFERRED EMBODIMENT

Figure 1A:
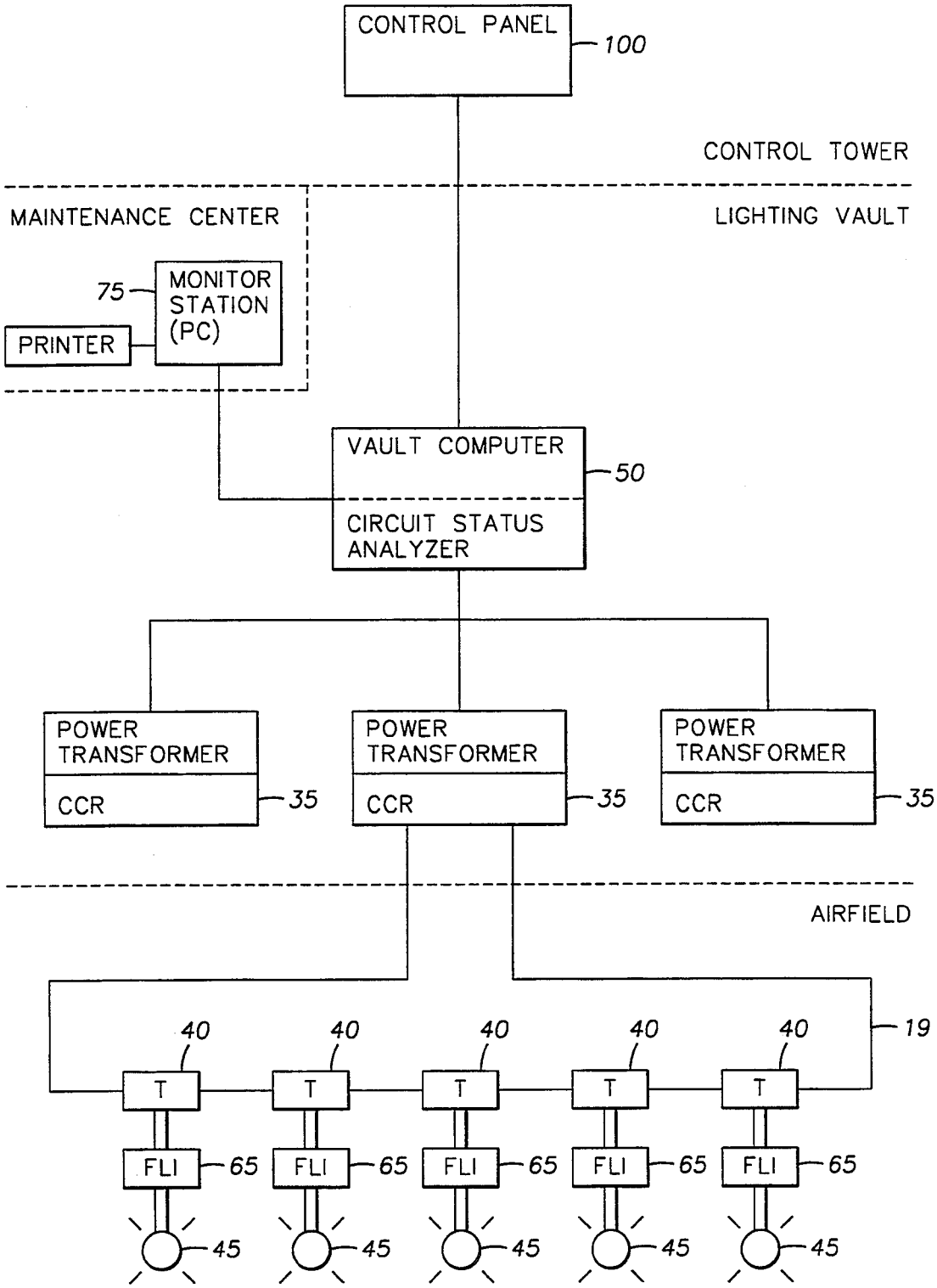
FIGS. 1A and 1B are block diagrams depicting the general layout of an airport runway lighting system constructed according to the principles of the present invention.
Figure 1B:
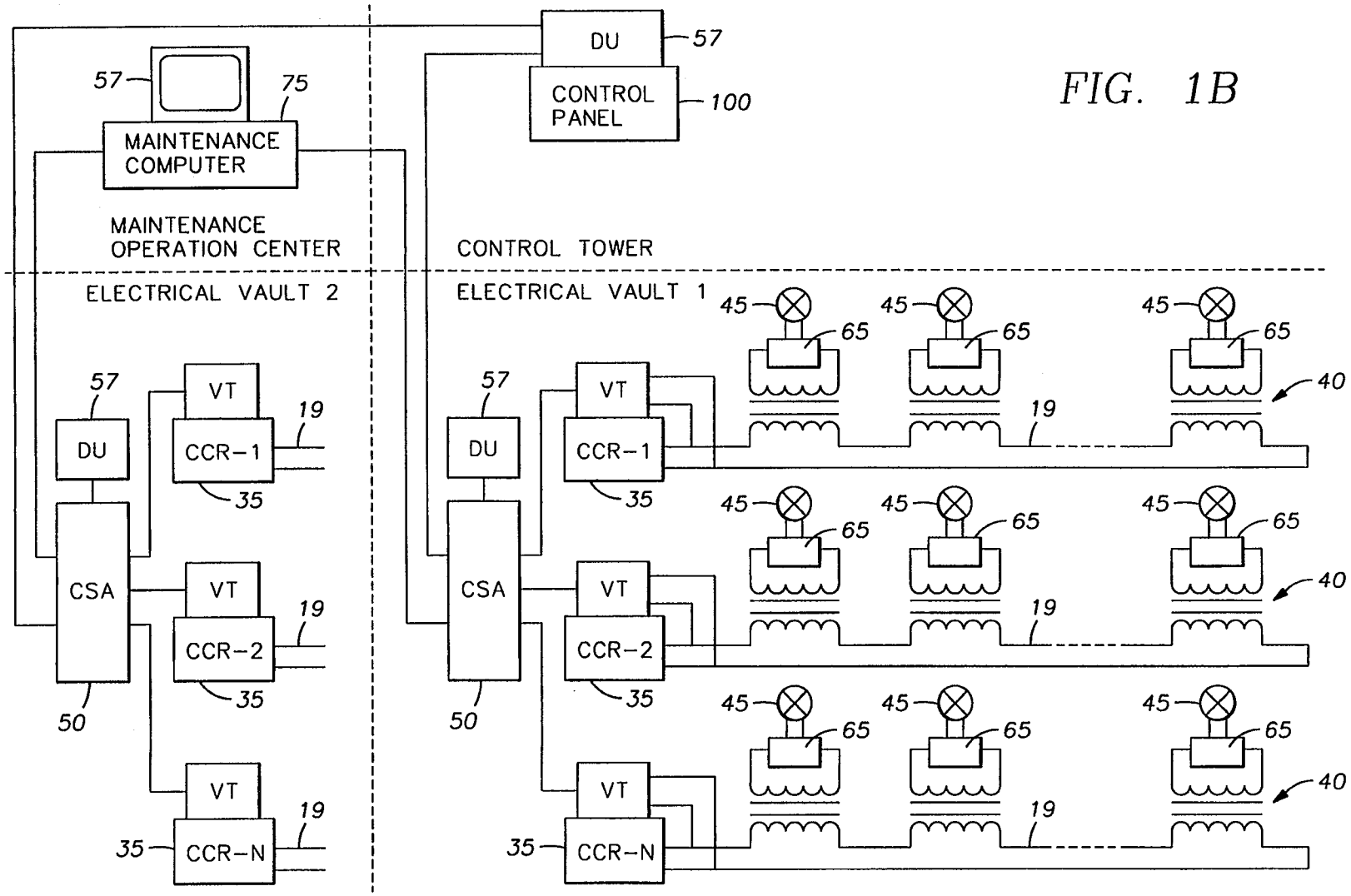

Referring now to FIGS. 1A and 1B, the runway lighting system constructed in accordance with the preferred embodiment comprises a series transmission line 19 connected through a current transformer 40 to a plurality of fixtures housing lamps 45, a failed lamp indicator ("FLI") 65 connected across the secondary of the current transformers 40 to each of the lamps 45, a constant current regulator ("CCR") 35 connected to the series runway transmission line 19, a vault computer and circuit status analyzer 50, a maintenance monitor station 75 and a control tower monitoring unit 100. The present discussion will focus on an automatic lamp monitoring system for a single runway. As shown in the preferred embodiment of FIG. 1B, a plurality of series runway transmission lines 19 all located in the same electrical vault, are connected, via a respective current regulator 35, to a single vault computer and circuit status analyzer 50. Each electrical vault has a similar vault computer 50. Each of these vault computers 50 connect to a computer in the maintenance monitoring station 75 and to a computer in the tower control unit 100. It will be understood by one skilled in the art that the following disclosure also applies to the other runways and associated circuitry.

Referring still to FIGS. 1A and 1B, the series runway lighting circuitry preferably comprises the existing transmission line 19 which connects the constant current regulator 35 to the light fixtures. A plurality of current transformers 40 provide coupling from the transmission line 19 to the lighting fixture circuitry. Because the preferred embodiment of the present invention envisions using the existing runway circuitry, including the constant current regulator 35, the series runway transmission line 19, and the current transformer 40, the cost of retrofitting a runway lighting system to include the automated monitoring system is kept to a minimum. The constant current regulator 35, transmission line 18 and transformer 40 are substantially the same as shown in commonly assigned U.S. Pat. No. 4,951,046, the teachings of which are incorporated by reference herein.

Referring still to FIGS. 1A and 1B, the series transmission line 19 preferably comprises the existing conductor through which the CCR 35 provides current to the lamps 45. Current transformers preferably connect in series at each fixture location to provide power to the lamps.

One constant current regulator CCR 35 preferably is associated with each series transmission line 19. The CCR, as substantially disclosed in U.S. Pat. No. 4,951,046, delivers current to the transmission line at a specific amperage level. Thus, each CCR independently controls the intensity of the associated lamps by varying the amperage level of the supplied current.

Figure 2:
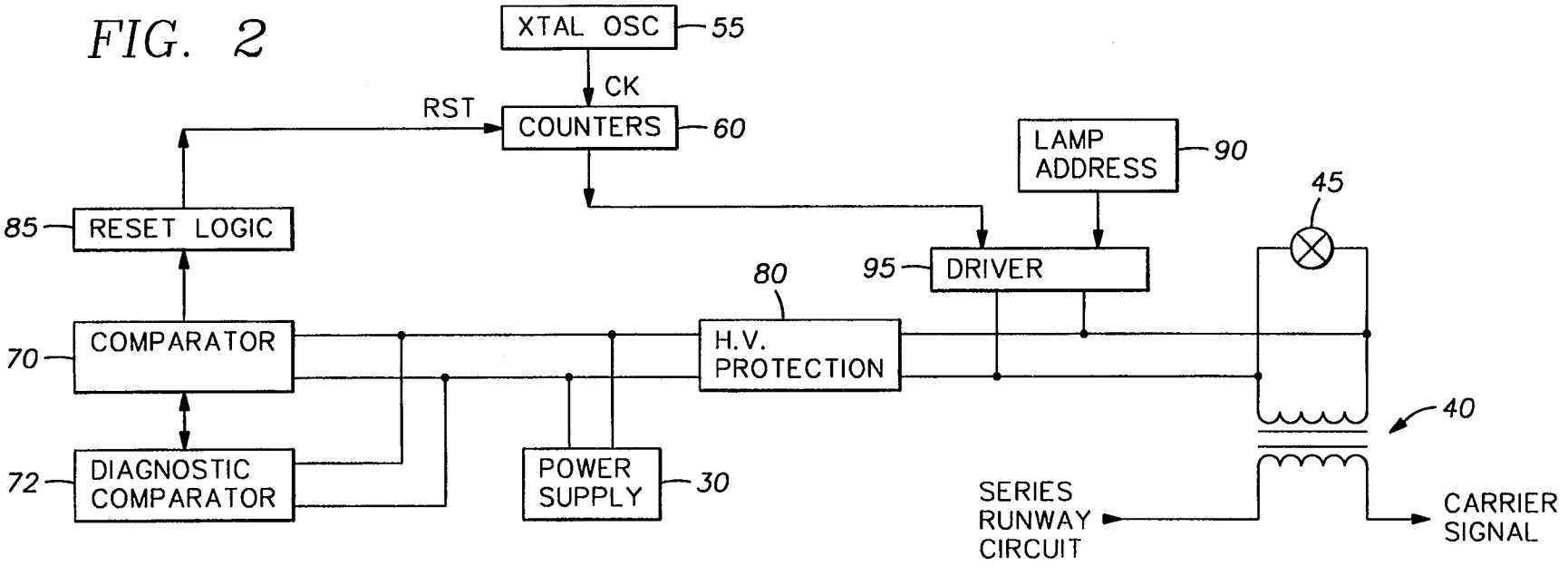
FIG. 2 is a block diagram of a failed lamp indicator used in the improved runway lighting system of FIG. 1.

Referring still to FIGS. 1A, 1B and 2, the failed lamp indicator 65 ("FLI") connects across the secondary of the current transformer and across the terminals of the light fixture. The FLI preferably includes comparator circuitry 70, high voltage protection circuitry 80, reset logic 85, an oscillator 55 and counter 60, a lamp address 90 and a driver 95. The FLI units preferably are installed in parallel to each lamp via two FAA L-823 connecters (not shown). A conventional power supply 30 is included in the FLI to provide DC power to the FLI circuitry. The power supply 30 connects to the current transformer 40 and receives power therefrom, preferably in the range of 2 VAC RMS to 12 VAC RMS.

Referring now to FIG. 2, the high voltage protection circuitry 80 connects across the secondary of the current transformer 40, and across the terminals of the lamp 45. The high voltage protection circuitry 80 preferably comprises conventional crowbar type protection with an automatic reset. The high voltage protection circuitry prevents spurious high voltage signals from overloading the FLI circuitry components.

The comparator circuitry 70 connects also across the terminals of the lamp 45 and senses the operating voltage of the lamp. The comparator circuitry 70 compares the operating voltage of the lamp 45 with a predetermined threshold voltage. When the operating voltage of the lamp 45 exceeds this threshold voltage, the comparator 70 transmits an output signal to the reset logic circuit 85, to initiate operation of the FLI. A diagnostic comparator 72 also is provided in association with the comparator circuitry 70 and is used for monitoring the operation of the FLI 65. When the FLI circuitry fails, the diagnostic comparator 72 causes the comparator 70 to transmit an output signal to the reset logic 85 to indicate failure of the FLI 65.

The reset logic circuitry 85 receives the output signal from the comparator 70 and initiates the process of transmitting an output signal to the vault computer a circuit status analyzer 50 (FIG. 1A and 1B), indicating that the lamp 45(or FLI) has malfunctioned.

Figure 3:
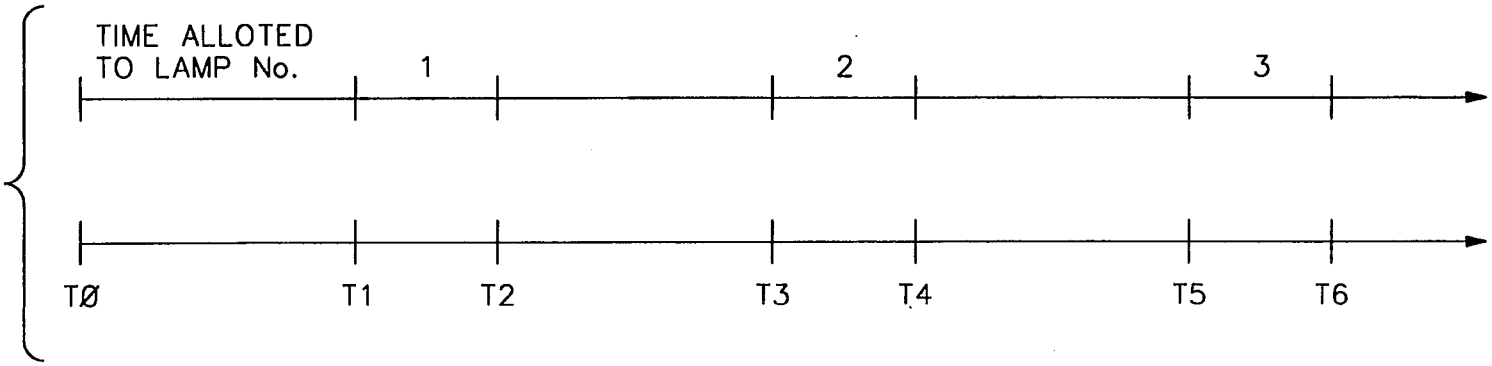
FIG. 3 is a time diagram illustrating the operation of the failed lamp indicator of FIG. 2.

A conventional crystal oscillator 55 and counter 60 are provided as part of the FLI 65 and provide a clocking and synchronizing feature. The oscillator 55, as is well known by one skilled in the art, serves as an internal clock for the FLI. The counter 60 receives a clock signal from the oscillator 55. In addition, the counter 60 is enabled when the CCR 35 begins emitting current or when the CCR 35 switches the amperage level of the emitted current. Thus, as shown in FIG. 3, lamp 1 must transmit its signal between times $T_1$ and $T_2$. Lamp 2 must transmit its signal during times $T_3$ and $T_4$. Time $T_0$ is determined from the time that the CCR 35 begins emitting current or changes the amperage of the current. Once enabled, the counter 60 begins counting the clock pulses from the oscillator. In addition, the reset input of the counter 60 receives the output signal from the reset logic 85. When a reset signal is received from the reset logic 85, the counter outputs its running total to the driver circuit 95.

Referring now to FIGS. 2 and 3, the lamp address circuitry 90 is encoded to a preset window, or time period, during which the FLI 65 must transmit a signal to the circuit status analyzer 50. Thus, the lamp address 90 is encoded with a number or value indicative of the time during which that particular FLI must transmit its signal to the CSA 50.

Referring still to FIG. 2, the driver circuit 95 connects across the terminals of the lamp 45. When an output is received from the counter 60, the driver 95 shunts out the lamp 45. The driver circuit 95 also compares the output signal from the lamp address 90 with the output, if there is one, from the counter 60. When the two signals are identical, the driver 95 opens the lamp for a predetermined length of time, after which the lamp 45 is again shunted. This opening of the lamp terminals occurs when the time period encoded in the lamp address 90 matches the time from the counter 60. As a result, the signal from that particular FLI 65 occurs during the preselected time period allotted to that FLI.

Because the signal from the FLI is the magnetic flow caused by an open circuit across the secondary of the current transformer 40, there is no possible interference from radio frequency waves or other electromagnetic waves. The FLI units 65 can be installed on all existing runways and to new runways, regardless of the type of constant current regulator 35 or the current transformer 40 in use, without the need to run additional transmission lines.

Referring again now to FIG. 1B, voltage transformer 33 preferably is used to couple the vault computer and circuit status analyzer 50, to the runway transmission line 19. The voltage transformer 33 includes a primary side operating at approximately 6000 V, and a secondary side operating at approximately 30 V. The primary side of the voltage transformer 33 connects to the runway transmission line 19. The secondary side of the voltage transformer connects to the circuit status analyzer 50. One voltage transformer 33 is required for each runway transmission line 19, and preferably is installed in the CCR 35.

The circuit status analyzer ("CSA") forms part of the electrical vault computer 50 and includes a read only memory (ROM) (not shown) in which the encoded periods stored in each lamp address 90 of each FLI 65 is stored in association with that particular FLI. The CSA monitors the magnetic flow in the runway transmission line 19. When a change in magnetic flow is detected, the CSA determines the period during which the flow occurred, and examines its read only memory to determine the corresponding lamp address for that specific time period or window. In this manner, the CSA pinpoints the FLI which emitted the signal.

After the CSA determines which lamps are burned out on each runway series circuit, the CSA then determines whether any adjacent lamps are malfunctioning. The results of the CSA's analysis are transmitted to the vault computer, the control tower 100 and the maintenance station 75 where the status of all lamps are displayed on display units 57.

The CSA preferably also runs calibration tests and other diagnostic tests to insure that the FLI and the runway lighting circuitry are operating correctly.

While a preferred embodiment of this invention has been disclosed, one skilled in the art will realize that modifications can be made without departing from the principle disclosed herein.

We claim:

1. A runway lighting system comprising:

a plurality of lamps for providing illumination along the runway;

a series transmission line supplying current to said lamps;

a plurality of monitoring means for monitoring each of said plurality of lamps to determine if any one of said lamps has malfunctioned, wherein one monitoring means is associated with each lamp in said runway lighting system;

a plurality of transmitting means, one of which is associated with each monitoring means, for transmitting a signal during a preassigned time window, which preassigned time window is unique for each lamp, on said transmission line indicating that the lamp associated with said monitoring means has malfunctioned, with said signal comprising a change in voltage and current on said transmission line; and circuit analyzing means connected to said transmission line for receiving said signal and monitoring the voltage and current in the transmission line and determining whether a change in magnetic flow has occurred.

2. A runway lighting system, comprising:

a plurality of lamps for providing illumination along the runway;

a series transmission line supplying current to said lamps;

a plurality of monitoring means for monitoring each of said plurality of lamps to determine if any one of said lamps has malfunctioned, wherein one monitoring means is associated with each lamp in said runway lighting system;

a plurality of transmitting means, one of which is associated with each monitoring means, for transmitting a signal on said transmission line indicating that the lamp associated with said monitoring means has malfunctioned, with said signal comprising a change in voltage and current on said transmission line, said transmitting means being adapted to transmit said signal during a preassigned time window, which preassigned time window is unique for each lamp, said signal indicating a change in the magnetic flow on said transmission line; and circuit analyzing means connected to said transmission line for receiving said signal and monitoring the voltage and current in said transmission line in order to detect changes in the magnetic flow on said transmission line.

3. A runway lighting system as in claim 2, wherein each of said monitoring means includes a lamp address, and each lamp address has encoded a specific time period during which said transmitting means must transmit.

4. A runway lighting system as in claim 3, wherein said circuit analyzer means includes a memory in which time periods are associated with specific lamp addresses.

5. The runway lighting system of claim 2 wherein said circuit analyzing means identifies which lamp has malfunctioned by determining during which time window said signal was transmitted.

6. The runway lighting system of claim 5 wherein said monitoring means and said transmitting means act to shunt out a malfunctioning lamp except during said preassigned window, whereby the opening of said malfunctioning lamp during said preassigned time window comprises said signal.

7. The runway lighting system of claim 5 wherein said circuit analyzing means is adapted to transmit lamp status information, which information is based on changes detected in the magnetic flow on said transmission line.

8. The runway lighting system of claim 7, further including a monitor connected to said circuit analyzing means for receiving and displaying said lamp status information.

9. The runway lighting system of claim 1 wherein said monitoring means and said transmitting means act to shunt out a malfunctioning lamp except during said preassigned window, whereby the opening of said malfunctioning lamp during said preassigned time window comprises said signal.

10. The runway lighting system of claim 1 wherein said circuit analyzing means is adapted to transmit lamp status information, which information is based on changes detected in the magnetic flow on said transmission line.

11. The runway lighting system of claim 10, further including a monitor connected to said circuit analyzing means for receiving and displaying said lamp status information.

* * * * *